United States Patent [19]

Olsson

[11] Patent Number: 4,694,129

[45] Date of Patent: Sep. 15, 1987

[54] CIRCUIT BOARD SWITCH HAVING IMPROVED SWITCH SPRING

[75] Inventor: Billy E. Olsson, New Cumberland, Pa.

[73] Assignee: AMP Incorporated, Harrisburg, Pa.

[21] Appl. No.: 868,367

[22] Filed: May 23, 1986

[51] Int. Cl.[4] ..... H01H 5/20

[52] U.S. Cl. ..... 200/68.2; 200/6 BB; 200/250

[58] Field of Search ..... 200/68.2, 291, 6 BB, 200/16 C, 16 D, 5 R, 250, 260

[56] References Cited

U.S. PATENT DOCUMENTS

| | | | |
|---|---|---|---|
| 3,403,236 | 9/1968 | Zoludow | 200/68.2 |
| 3,403,237 | 9/1968 | Wysong | 200/68.2 |
| 4,320,271 | 3/1982 | Munroe | 200/68.2 |
| 4,531,030 | 7/1985 | Gingerich et al. | 200/68.2 |

FOREIGN PATENT DOCUMENTS

| | | | |
|---|---|---|---|
| 2335932 | 7/1977 | France | 200/16 D |

*Primary Examiner*—Stephen Marcus
*Assistant Examiner*—Renee S. Luebke
*Attorney, Agent, or Firm*—Frederick W. Raring; Bruce J. Wolstoncroft

[57] ABSTRACT

Dual-in-line switch comprises a housing assembly having a plurality of side-by-side slide housings therein. The slide housings each have a spring means therein which bears against a pivoted contact bar which overlaps the first and second switch conductors and is pivoted on one of the conductors. When the slide housing is moved, it causes rocking of the contact bar to change the condition of the switch. The spring means in the slide housing comprises two bellows springs, each of which has a fixed end which bears against the interior wall of the slide housing and a free end. The free ends are integral with each other and bear against the rockable contact bar.

10 Claims, 5 Drawing Figures

CIRCUIT BOARD SWITCH HAVING IMPROVED SWITCH SPRING

BACKGROUND OF THE INVENTION

A commonly known type of switch used on circuit boards comprises a generally rectangular housing assembly having a plurality of individual switches therein. Each switch serves to connect two circuit board conductors and has a slide member therein which changes the condition of the switch whenever the slide member is moved from one position to another position. Switches of this type are commonly referred to as DIP switches for the reason that they ideally should have the same dimensions as a standard dual-in-line package of the class used for packaging integrated circuits or the like.

The standard width for a DIP switch is about 0.276 inches and the length of the switch will depend upon the number of switch units contained in the assembly. The length of each switch unit should be about 0.100 inches in order that it will conform to standard circuit board conventions.

One type of DIP switch has a rockable contact bar for each switch unit which is pivoted on one of the switch conductors in the switch assembly and which is rocked between first and second positions to change the condition of the switch. The bar is pivoted on one of the switch conductors so that in one position, it electrically connects the two switch conductors in the switch unit and in the other position, the conductors are not connected to each other. The rockable contact bar is rocked by means of a spring contained in a slide housing which forms part of the DIP switch housing assembly. The provision of the spring poses one of the most troublesome problems in the design of DIP switches for the reason that the spring must be very small but at the same time the force with which the spring bears against the contact bar must be precisely controlled. This force should not be unduly high for the reason that if it is, the switch will wear out in a very short time because of abrasion. On the other hand, the force exerted must be sufficient to establish good contact when the switch is closed. Also, the spring should be as small as reasonably possible particularly as regards its height so that the overall height of the DIP switch assembly, including the housing assembly, will not greatly exceed the standard dimensions of a conventional dual-in-line package of an integrated circuit.

U.S. Pats. Nos. 4,191,867, 4,531,030, 4,311,884, and 4,268,728 disclose different approaches to the DIP switch design problem. U.S. Pat. No. 4,531,030 shows a widely used type of DIP switch in which the spring is a bellows spring having several bellows spring sections, one of which bears against the rockable contact bar and the other one of which bears against an interior wall of the switch housing. In many respects, a bellows spring is ideally suited for use in DIP switches for the reason that its contact force can be accurately controlled and will not be unduly high. It would be desirable, however, to reduce the overall height of the type of DIP switch shown in the above-identified U.S. Pat. No. 4,531,030 while retaining the advantages of a bellows spring. The present invention is directed to the achievement of an improved DIP switch having a bellows spring means which permits a substantial reduction in the overall height of the DIP switch assembly and which achieves other advantages as will be explained below.

THE INVENTION

In accordance with one embodiment, the invention comprises a switch which is intended for mounting on a circuit board or the like, the switch comprising a housing assembly having a mounting face, a top face which is directed oppositely with respect to the mounting face, oppositely facing first and second housing sidewalls, and oppositely facing housing endwalls. First and second fixed switch conductors extend through the switch housing sidewalls and have contact ends which are proximate to each other in the housing assembly. A contact bar is provided in the housing assembly which is in overlapping relationship to the contact ends. The second fixed conductor has a fulcrum on its contact end on which the contact bar is rockably supported and a slide housing is provided which is between the first and second housing sidewalls and which is movable between a first position, in which the slide housing is proximate to the first sidewall and a second position in which the slide housing is proximate to the second sidewall. A spring-receiving recess is provided in the slide housing and a spring means is disposed in the spring recess. The spring means is in resilient engagement with the contact bar and is effective to hold the first end of the contact bar against the first fixed contact when the slide housing is in the first position and is effective to hold the contact bar disengaged from the first fixed contact when it is in the second position. The switch is characterized in that the spring means comprises first and second bellows springs, each bellows spring having a fixed end, a free end, and at least two compressible bellows spring sections between its fixed end and its free end. The spring-receiving recess has a central axis which extends normally of the housing assembly sidewalls and the free ends of the bellows springs are substantially on the central axis and are connected to each other at a bearing portion which is proximate to the mounting face. The fixed ends are spaced from the central axis and bear against opposed wall portions of the recess on opposite sides of the central axis. The fixed ends are proximate to the top surface of the housing assembly. The spring means is compressed in the direction parallel to the central axis so that the bearing portion bears resiliently against the contact bar. The spring means is also compressed inthe direction normally of the central axis and towards the central axis so that the fixed ends of the bellows springs bear resiliently against the opposed wall portions of the recess and thereby hold the spring means securely in the recess.

THE DRAWING FIGURES

THE DISCLOSED EMBODIMENT

Figure 1:
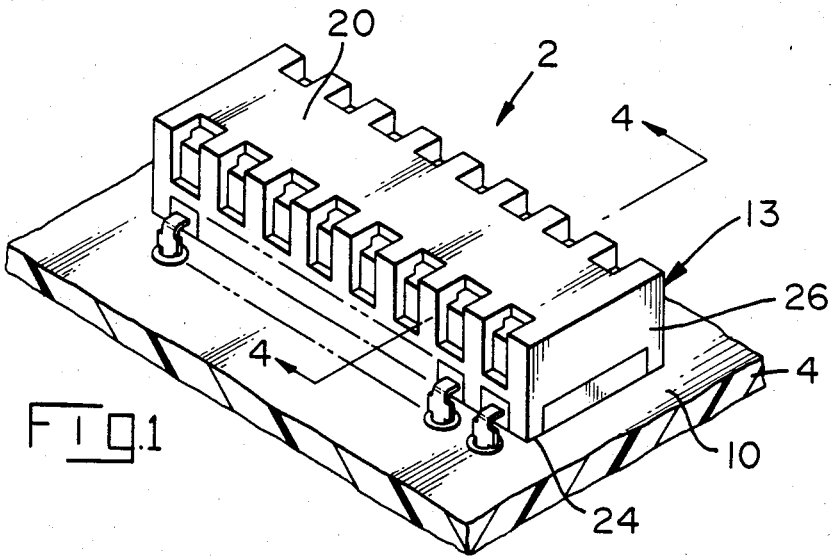
FIG. 1 is a perspective view of a switch assembly in accordance with the invention mounted on a circuit board or other substrate.
Figure 3:
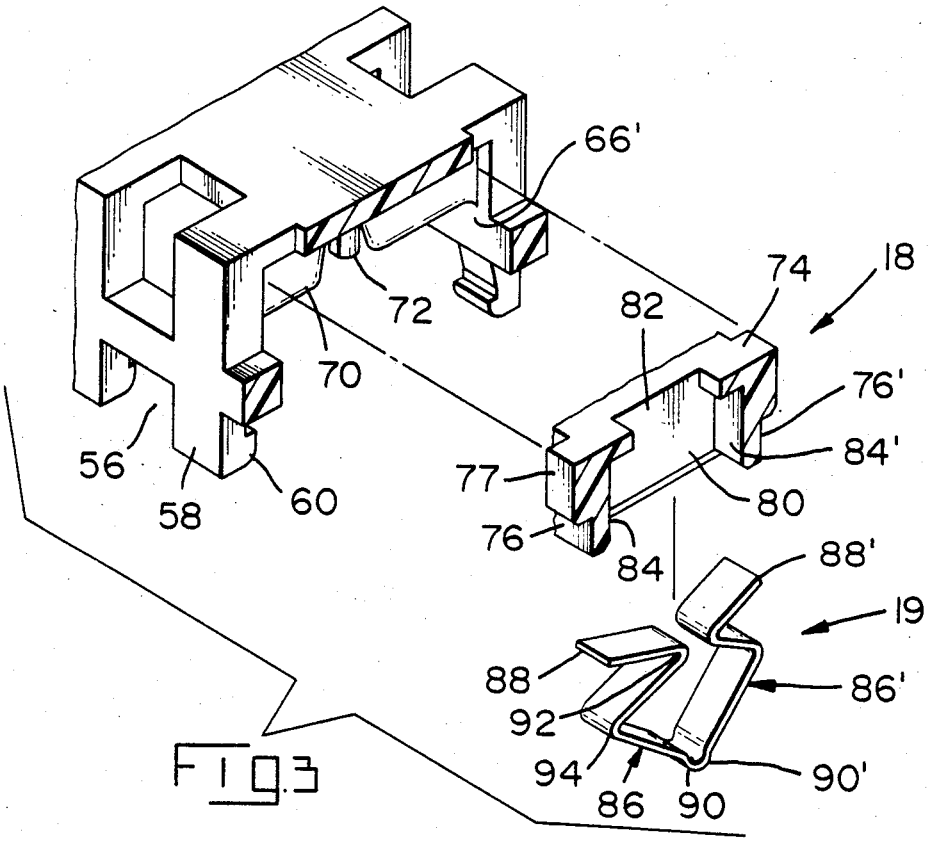
FIG. 3 is an enlarged perspective fragmentary view showing the spring means, the slide housing, and portions of the cover member.
Figure 2:
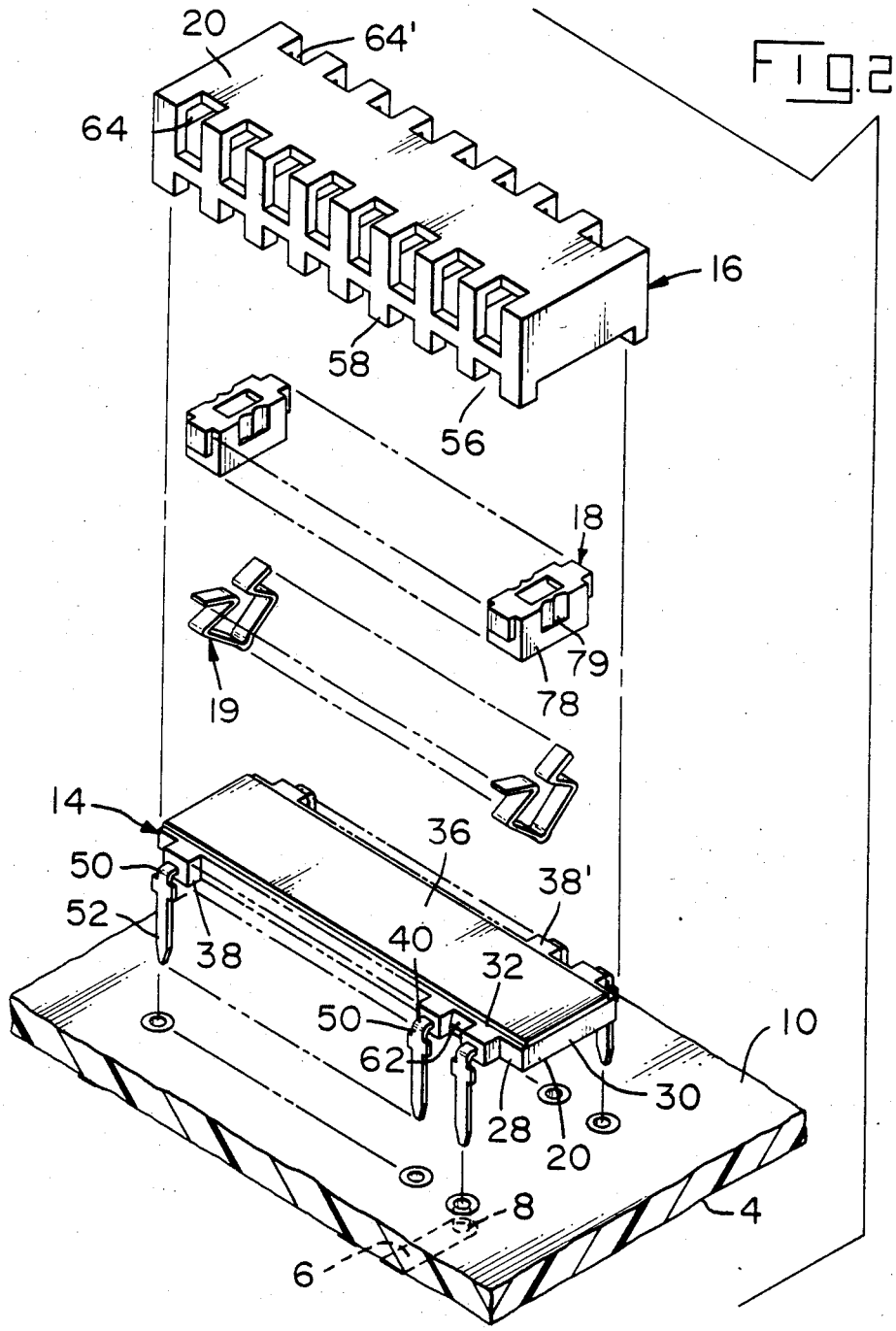
FIG. 2 is a view similar to FIG. 1 showing the parts exploded from each other.

A DIP switch assembly 2 in accordance with the invention is intended to be mounted on the upper surface 10 of a circuit board 4 having first and second conductors 6, 6' on its lower surface 12. The conductors 6, 6' have ends 8, 8' which extend to openings in the circuit board.

The switch assembly 2 comprises a housing assembly 13 which is composed of a base portion 14, a cover 16, and a plurality of slide housings 18, each of which contains a spring means 19. The housing assembly has an upwardly facing top face 20, a mounting face 22 which is opposed to the surface 10 of the circuit board, first and second oppositely facing sidewalls 24, 24' and oppositely facing endwalls 26. As shown best in FIG. 4, the assembly is symmetrical with respect to a vertical axis which extends normally of the lower and upper faces 22, 20. Corresponding structural features on the left-hand side and the right-hand side of this axis are identified by the same reference numerals, differentiated by prime marks. The structural features on the left-hand side of the axis are in general referred to as "first" and the corresponding features on the right-hand side are referred to as "second" as in the first and second sidewalls, 24, 24'.

The base portion 14, the cover 16, and the slide housings 18 are all of plastic material manufactured by injection molding processes.

The base portion 14 has oppositely facing side surfaces 28, 28', oppositely facing end surfaces 30, 30' and an upper surface 32. the lower surface of the baes portion is the mounting face 22 of the assembly.

A shallow recess 34 extends into upper surface 32 and a sealing membrane 36 covers this recess and is bonded to the surface 32. Spaced-apart projections 38, 38' extend from the side surfaces 28, 28' respectively and first and second switch conductors 40, 40' extend into these projections and have contact ends 42, 42' in the recess 34. The end 42' of the switch conductor 40' has an inverted V 44 on its end which serves as a fulcrum for a contact bar 46 which overlaps the end portions of the conductors 40, 40'. The end 48 and the supported zone 49 of the contact bar serve as contacts. It will be apparent from FIG. 4 that when the contact bar is in the position of that figure, the conductor 40 is electrically connected to the conductor 40'. If the contact bar is swung through a slight clockwise arc, the end 48 is lifted from the end 42 of conductor 40 and the conductors are not connected to each other.

The conductors 40, 40' are bent downwardly as shown at 50 adjacent to the projections 38 and have post portions 52 which extend through the openings in the circuit board. These posts are soldered to the conductors 6, 6' on the underside of the board as shown. It should be mentioned that the principles of the invention can also be used if the conductors 6, 6' are on the upper surface 10 of the circuit board in which case the switch conductors will be connected to the circuit board conductors by surface mounting techniques.

The cover member 16 has a hollow interior 54 and has spaced-apart notches 56 in its sidewalls adjacent to their lower edges. These notches are dimensioned to receive the projections 38 of the base portion and they define spaced-apart latching arms 58 which have inwardly directed ends 60. These ends 60 are dimensioned to be latched to latch ears 62 which are between the projections 38 on the base member. The interior of the cover member has opposed interior sidewalls first and second 66, 66', an internal top wall 68, and barrier walls 70 which are between adjacent openings 64. The openings 64, 64' are windows in the top wall and in the sidewalls and permit access to the slide housings in order to change the condition of switch units as will be described below.

The barrier walls 70 define side-by-side cavities or compartments, each of which contains a slide housing 18. Each barrier wall includes an arm 72 which is midway between the internal walls 66, 66' and which cooperates with detents recesses in the slide housings as described below. It will be apparent that the switch assembly comprises a plurality of individual switches in side-by-side relationship between the endwalls 26 of the assembly. Each slide housing 18 has a top wall 74, oppositely facing sidewalls 76, 76', and endwalls 78. The sidewalls have projecting bosses 77 which fit into the windows 64 in the cover member. Detent recesses 79 are provided in the endwalls 78 which receive the arms 72 of the adjacent barrier walls 70. Each recess comprises two side-by-side pockets so that the slide member can be positioned in either of its two possible positions as will be explained below.

Each slide housing 18 has a hollow interior and an opening 82 in its top wall which extends to the interior. The interior has endwalls 80, a recess top wall 81 and opposed sidewalls 84, 84'. The interior of each housing 18 constitutes a spring-receiving recess or cavity for reception of an individual spring means 19.

Figure 4:
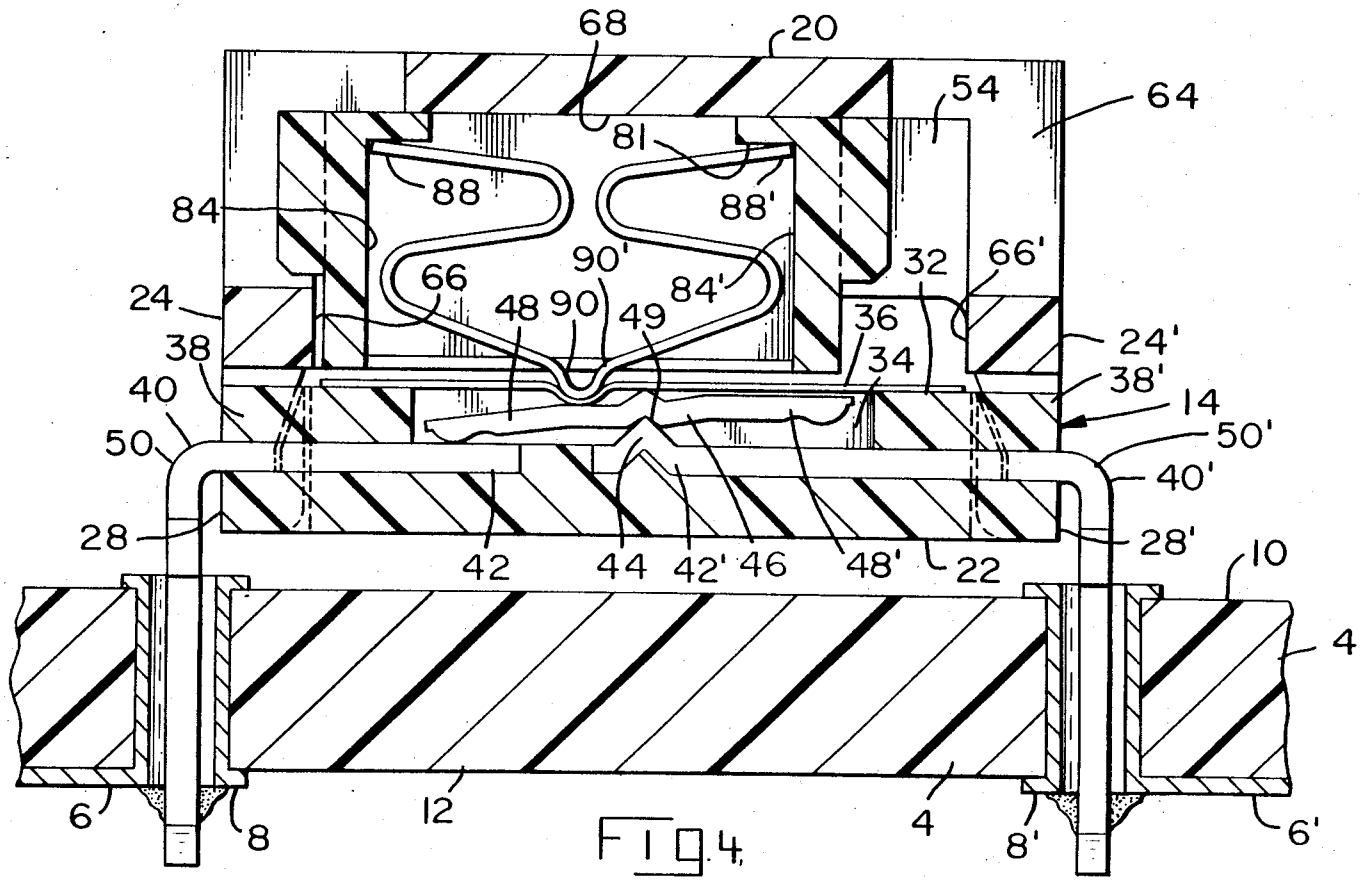
FIG. 4 is a cross-sectional view looking in the direction of the arrows 4—4 of FIG. 1.

Each spring means 19 comprises in effect two separate bellows springs 86, 86' which are mirror images of each other and are on each side of a central axis. Each bellows spring thus has an upper or fixed end 88, a lower or free end 90, and at least two bellows spring sections in between defined by reverse bends 92, 94. The free ends 90 are connected to or integral with each other and formed to define a bearing portion which bears against the surface of the membrane as shown in FIG. 4. It will be noted that the reverse bends are spaced from the interior sidewalls of the slide housing so that the bellows springs are free to compress in a vertical direction as viewed in FIG. 4.

Figure 5:
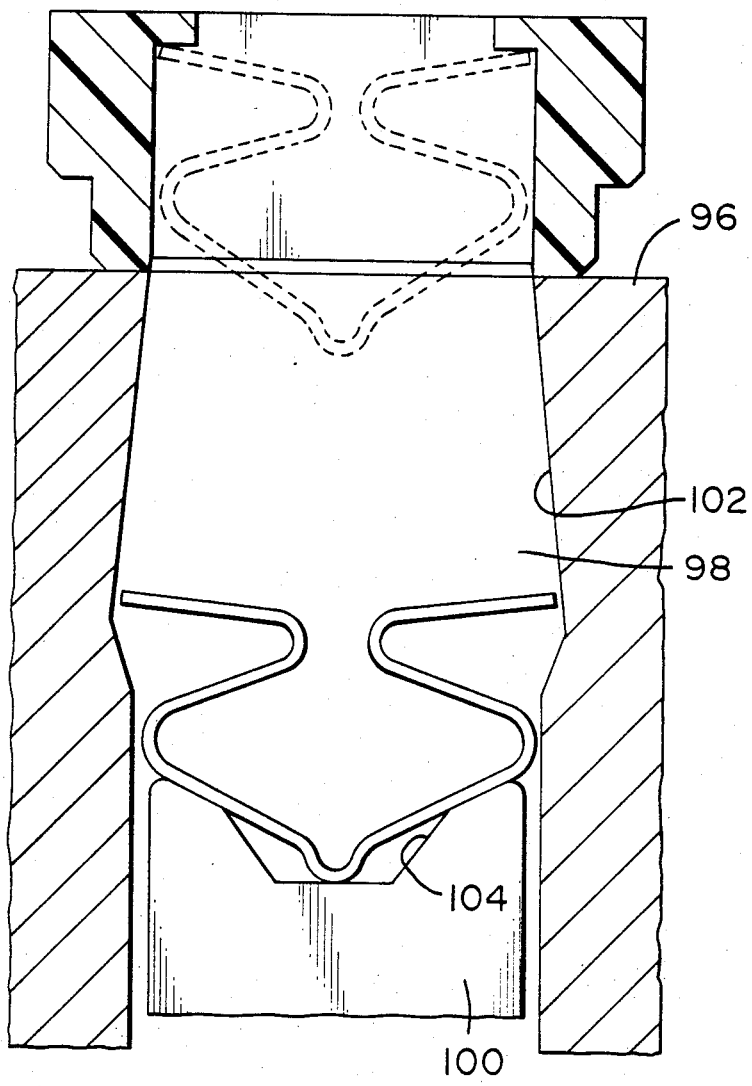
FIG. 5 is a sectional view showing portions of the assembly tooling for assembling the springs means to the slide housing.

The springs are assembled to the individual slide housings 18 by tooling as shown in FIG. 5. The assembly tooling comprises a guide member 96 having a passageway 98 which extends to one surface of the guide 96 on which a slide housing is positioned with its spring-receiving opening in alignment with the end of the passageway. The passageway has convergent sides 102 and an insertion tool 100 is provided which has a leading end 104 that is contoured to engage a spring member as shown in FIG. 5. When the insertion tool 100 moves upwardly from the position of FIG. 5, the ends 88, 88' of the spring are pushed inwardly so that the spring is flexed in a horizontal sense towards its central axis. It can therefore be pushed into the cavity in the slide housing and when it reaches the top wall and the tool 100 is withdrawn, the ends 88, 88' will resiliently bear against the opposed sidewalls and the top wall. The spring will thus be securely held in the cavity in the slide housing and the slide housing can readily be assembled to the cover member and the base portion of the switch assembly.

When the slide housings with the springs therein are assembled to the cover member, and the cover member is thereafter assembled to the base, the individual springs will be compressed in a vertical direction so that the ends 90, 90' of the springs will bear against the membrane as shown in FIG. 4. The spring in each slide housing will resiliently bias the slide housing upwardly against the top wall surface 68 so that the slide housing will not be loose and cannot rattle.

The operation of the device will be apparent from the drawing. FIG. 4 shows the switch in a condition such that the conductor 40 is electrically connected to the conductor 40'. The slide housing can be said to be in its first position in that the slide housing is proximate to the left-hand side of the cover. If the slide housing is moved rightwardly, the bearing portion of the spring moves over the fulcrum and bears against the right-hand portion of the rocker member 46 so that the conductors 40, 40' are not electrically connected to each other.

Several significant advantages are achieved in the practice of the invention. As mentioned previously, the provision of two bellows springs which are connected to each other at their lower ends results in improved spring characteristics at a reduction in the overall height of the switch assembly. The height reduction is achieved by virtue of the fact that notwithstanding the fact that the spring means has four bellows spring sections, the sections are divided between the two springs and are not on top of each other. A distinct manufacturing advantage is achieved by virtue of the fact that after the individual springs have been inserted into the slide housings as shown in FIG. 5, they will be held securely in position by virtue of the horizontal resilient deformation of each spring means and the slide housings, with the springs assembled thereto, can be handled by automatic machinery and assembled to the cover member and the base member. As also shown by FIG. 4, the spring, in bearing against the top wall of the slide housing, biases the slide housing upwardly and against the internal wall 68 of the cover member. This maintains the lower end of the slide housing away from the membrane and prevents any possible damage to the surface of the membrane which might occur if the slide housing were to be dragged over the membrane whenever the condition of an individual switch unit was changed.

A further advantage is achieved by virtue of the fact that the projections 38 are provided on the base and the cover member is latched to the base by means of the latch arms 58 and the ears 62 on the cover member and the base respectively. The projections 38 provide an added section of plastic material for supporting the conductors 40, 40' while maintaining the dimensions which are required of a standard DIP switch. The added support for the conductors 40, 40' is represented by the projecting portions 38 of the base and is extremely important in that portions of the conductors which would otherwise be exposed are embedded in plastic material and thereby protected against damage.

The operation of the individual switch units in the switch assembly is extremely smooth and the detent effect experienced by the operator is distinct, whether the switch is moved from first position to the second position or in the opposite direction. The smoothness of operation results from the fact that the individual slide housings are biased upwardly by the springs as noted above. An added advantage is that the force with which the springs bear against the membranes can be closely controlled during manufacture as a result of the fact that the individual springs are bellows springs.

What is claimed is:

1. A switch which is intended for mounting on a circuit board or the like, the switch comprising a housing assembly having a mounting face, a top face which is directed oppositely with respect to the mounting face, oppositely facing first and second housing sidewalls and oppositely facing housing endwalls, first and second fixed switch conductors which extend through the switch housing sidewalls and which have contact ends which are proximate to each other in the housing assembly, a contact bar in the housing assembly which is in overlapping relationship to the contact ends, the second fixed conductor having a fulcrum on its contact end on which the contact bar is rockably supported, a slide housing which is between the first and second housing assembly sidewalls and which is movable between a first position, in which the slide housing is proximate to the first housing sidewall, and a second position, in which the slide housing is proximate to the second housing sidewall, a spring-receiving recess in the slide housing and a spring means in the recess, the spring means being in resilient engagement with the contact bar and being effective to hold the first end of the contact bar against the first fixed contact when the slide housing is in the first position and being effective to hold the contact bar disengaged from the first fixed contact when it is in the second position, the switch being characterized in that:

the spring means comprises first and second bellows springs, each bellows spring having a fixed end, a free end, and at least two compressible bellows spring sections between its fixed end and its free end, the spring-receiving recess having a central axis which extends normally of the housing assembly sidewalls, the free ends of the bellows springs being substantially on the central axis and being connected to each other at a bearing portion which is proximate to the mounting face, the fixed ends being spaced from the central axis and being against opposed wall portions of the recess on opposite sides of the central axis, the fixed ends being proximate to the top face, the spring means being compressed in the direction parallel to the central axis so that the bearing portion bears resiliently against the contact bar, the spring means being compressed in the direction normal to the central axis so that the fixed ends of the bellows springs bear resiliently against the opposed wall portions of the recess, such that the cooperation of the fixed ends with the wall portions ensures that the spring means will be centered in the recess and resiliently maintained in that position.

2. A switch as set forth in claim 1 characterized in that each bellows spring has at least two reverse bends which are between its fixed end and its free end, the reverse bends being spaced from the opposed wall portions so that the spring means is freely compressed in the direction parallel to the central axis.

3. A switch as set forth in claim 2 characterized in that the recess in the slide housing has opposed recess sidewalls, opposed recess endwalls, and a recess top wall which is parallel to the housing assembly top wall and which extends normally of the recess sidewalls and the recess endwalls, the fixed ends being against the opposed recess sidewalls and against the recess top wall whereby the spring means is retained in the recess by virtue of the compression of the spring means in the direction normal to the central axis and the resulting resilient bearing of the fixed ends of the spring means against the opposed recess sidewalls, and the slide housing is resiliently biased against the recess top wall by virtue of the compression of the spring means in the direction parallel to the central axis.

4. A switch as set forth in claim 3 and a plurality of identical switches, all of the switches being in side-by-side stacked relationship.

5. A DIP switch assembly which is intended for mounting on a circuit board or the like, the DIP switch assembly comprising a housing assembly having a mounting face, a top face which is directed oppositely with respect to the mounting face, oppositely facing first and second housing sidewalls and oppositely facing housing endwalls, a plurality of switch units in stacked side-by-side relationship in a row which extends between the housing endwalls, each switch unit comprising first and second fixed switch conductors which extend through the switch housing sidewalls and which have contact ends which are proximate to each other in the housing assembly, a contact bar which is in overlapping relationship to the contact ends, the second fixed conductor having a fulcrum on its contact end on which the contact bar is rockably supported, each switch unit further comprising a slide housing which is between the first and second housing assembly sidewalls and which is movable between a first position, in which the slide housing is proximate to the first housing sidewall, and a second position, in which the slide housing is proximate to the second housing sidewall, a spring-receiving recess in the slide housing and a spring means in the recess, the spring means being in resilient engagement with the contact bar and being effective to hold the first end of the contact bar and being effective to hold the first end of the contact bar against the first fixed contact when the slide housing is in the first position and being effective to hold the contact bar disengaged from the first fixed contact when it is in the second position, the DIP switch assembly being characterized in that:

each spring means comprises first and second bellows springs, each bellows spring having a fixed end, a free end, and at least two compressible bellows spring sections between its fixed end and its free end, the spring-receiving recess having a central axis which extends normally of the housing assembly sidewalls, the free ends of the bellows springs being substantially on the central axis and being connected to each other at a bearing portion which is proximate to the mounting face, the fixed ends being spaced from the central axis and being against opposed wall portions of the recess on opposite sides of the central axis, the fixed ends being proximate to the top face, the spring means being compressed in the direction parallel to the central axis so that the bearing portion bears resiliently against the contact bar, the spring means being compressed in the direction normal to the central axis so that the fixed ends of the bellows springs bear resiliently against the opposed wall portions of the recess, such that the cooperation of the fixed ends with the wall portions ensures that the spring means will be centered in the recess and resiliently maintained in that position.

6. A DIP switch as set forth in claim 5 characterized in that each bellows spring has at least two reverse bends which are between its fixed end and its free end, the reverse bends being spaced from the opposed wall portions so that the spring means is freely compressed in the direction parallel to the central axis.

7. A DIP switch as set forth in claim 6 characterized in that the recess in the slide housing has opposed recess sidewalls, opposed recess endwalls, and a recess top wall which is parallel to the housing assembly top wall and which extends normally of the recess sidewalls and the recess endwalls, the fixed ends being against the opposed recess sidewalls and against the recess top wall whereby the spring means is retained in the recess by virtue of the compression of the spring means in the direction normal to the central axis and the resulting resilient bearing of the fixed ends of the spring means against the opposed recess sidewalls, and the slide housing is resiliently biased against the recess top wall by virtue of the compression of the spring means in the direction parallel to the central axis.

8. A DIP switch assembly as set forth in claim 5 characterized in that the housing assembly comprises a base portion and a cover, the base portion having a central recess, the first and second switch conductors being embedded in the base portion, the contact ends being in the central recess.

9. A DIP switch assembly as set forth in claim 8 characterized in that a sealing membrane is provided in covering relationship to the recess.

10. A DIP switch assembly as set forth in claim 9 characterized in that the base portion has spaced apart projecting portions, the first and second conductors extending through and being embedded and supported in, the projecting portions, the base portion having integral locking ears which are between the projecting portions, the cover having oppositely facing cover sidewalls which constitute the sidewalls of the housing assembly, the cover sidewalls having openings therein, the projecting portions being in the openings, and the cover sidewalls having latching arm means between the openings for cooperation with the locking ears to latch the cover to the base.

* * * * *